United States Patent [19]

Thompson

[11] 3,984,031

[45] Oct. 5, 1976

[54] MEDICATION DISPENSER DEVICES WITH SAFETY LOCK MEANS

[76] Inventor: Gordon J. Thompson, 621 Running Water Circle SE., Albuquerque, N. Mex. 87123

[22] Filed: Mar. 10, 1975

[21] Appl. No.: 556,555

[52] U.S. Cl. ..... 221/82; 221/154; 206/538

[51] Int. Cl.[2] ..... B65D 83/04

[58] Field of Search ..... 221/2, 4–5, 221/76, 82, 83, 154, 152, 91; 206/538, 528, 533, 534, 539, 405–406, 1.5

[56] References Cited

UNITED STATES PATENTS

| | | | |
|---|---|---|---|
| 2,828,005 | 3/1958 | Ricke | 206/534 X |
| 3,085,679 | 4/1963 | Burrell | 221/4 X |
| 3,870,192 | 3/1975 | Haley | 221/154 X |
| 3,895,737 | 7/1975 | Phillips | 221/82 |

FOREIGN PATENTS OR APPLICATIONS

| | | | |
|---|---|---|---|
| 442,615 | 1/1968 | Switzerland | 206/534 |

*Primary Examiner*—Robert B. Reeves
*Assistant Examiner*—Charles A. Marmor
*Attorney, Agent, or Firm*—Brezina & Lund

[57] ABSTRACT

Devices are disclosed including a dispenser having a wall closing compartments of a container with an opening in the wall being moveable over a selected compartment, the compartments being preferably in angularly spaced relation about an axis on which the dispenser rotates. An engagement member is provided for engagement by one finger to release a lock device which normally securely locks the dispenser against movement relative to the container while the dispenser is engagable by another finger for movement thereof. In one embodiment, the lock device includes a lock bar carried by the dispenser and having outer end portions engageable in diametrically opposed slots in a ring carried by the container means. In another embodiment, a resiliently deformable element is carried by the container and has a portion engageable in angularly spaced slots of a projecting portion of the dispenser, such projecting portion also serving to journal the dispenser on the container.

5 Claims, 7 Drawing Figures

MEDICATION DISPENSER DEVICES WITH SAFETY LOCK MEANS

This invention relates to medication dispenser devices and more particularly to medication dispenser devices having safety features such as to prevent operation by young children. The device is relatively simple in construction and operation and is economically manufacturable while being highly reliable.

BACKGROUND OF THE PRIOR ART

Medication dispenser devices have heretofore been provided including a wall closing compartments of container means and moveable to position an opening therein over a selected compartment for removal of a discrete dosage of medication therefrom. Such prior art devices have been relatively inexpensive in construction, quite easy to operate and generally satisfactory for the purpose of carrying and dispensing discrete dosages of medication when desired.

SUMMARY OF THE INVENTION

This invention is based in part upon the recognition that portable medication dispenser devices can and frequently do come into the hands of small children and if such devices are easily operated, the children may remove and swallow the medication, resulting in serious if not fatal illness.

This invention was evolved with the general object of providing medication dispenser devices which are readily and easily operable by adults but which cannot be easily operated by small children. Another object is to provide medication dispenser devices which are simple in construction and operation, economically manufacturable and highly reliable.

According to this invention, dispenser means are provided having a wall or a closing open ends of compartments of container means with the dispenser means being moveable relative to the container means to position an opening in the wall over the open end of a selected compartment. First engagement means are provided for engagement by one finger of the user to operate a lock release of lock means which securely lock the dispenser means relative to the container means and second engagement means are provided for engagement by another finger to move the dispenser means. With this arrangement, the device is normally locked and operation requires the use of two fingers of the user simultaneously which is difficult for young children to accomplish.

Preferably, and in accordance with specific features, the engagement means are spaced a substantial distance apart and are moveable in different directions, to further insure against the possibility of operation by young children.

The devices preferably are of a type in which the dispenser means is rotatably mounted on the container means with the compartments disposed in angularly spaced relation in a fixed radial distance from the axis of rotation of the dispenser means, and with the open ends of the compartments being in a plane transverse to the axis of rotation and adjacent the wall of the dispenser means. The dispenser means has a peripheral rim portion forming the second engagement means.

Another feature is in the location of the lock, lock release and first engagement means inside an inner annular wall means defining walls of the compartments and between the plane of the open ends of the compartments and the plane of bottom walls of the compartments.

According to an important specific feature, journalling means project from the wall of the dispenser means through a circular opening in a wall of the container means to journal the dispenser means for rotation and the lock means comprises a pair of coacting means respectively associated with the container and the projection means with one of the pair of coacting means defining a plurality of angularly spaced slots and the other comprising an element moveable into a selected slot.

In one embodiment a ring is provided on the wall of the container means radially inside the compartment and having angularly spaced slots with a resilient lock bar being mounted on the projection means to engage in such slots. The lock bar preferably has a central portion forming the first engagement means and is moveable toward the wall of the dispenser means to move outer end portions of the bar out of diametrically opposed slots in the ring.

In another embodiment, the projection means of the journalling means has angularly spaced slots formed thereon and a resiliently deflectable element is mounted on the container means to move into such slots, the element preferably having an inner end portion moveable radially outwardly to move such portion out of the slots.

The devices so constructed are easy to use and economically manufacturable while being highly reliable and being quite difficult to operate by young children while being readily operated by adults.

This invention contemplates other objects, features and advantages which will become more fully apparent from the following detailed description taken in conjunction with the accompanying drawings.

DESCRIPTION OF PREFERRED EMBODIMENTS

Figure 1:
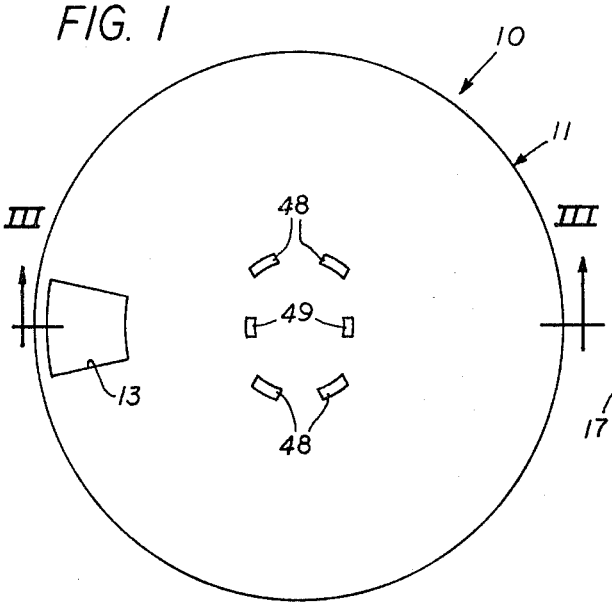
FIG. 1 is a top plan view of a medication dispenser device constructed in accordance with the invention.
Figure 2:
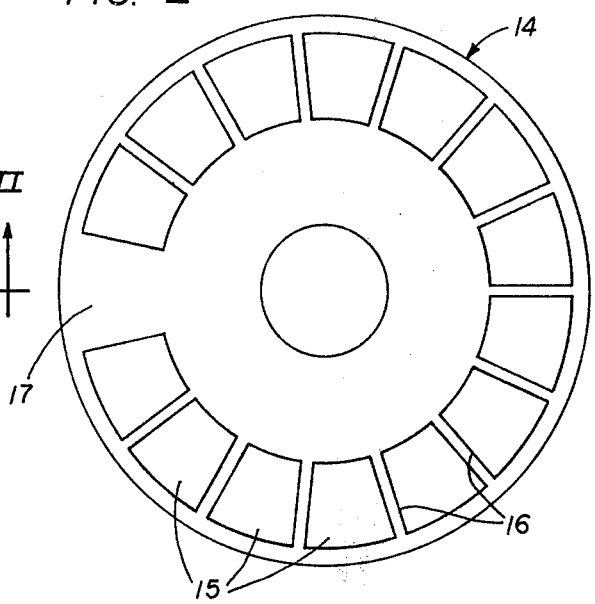
FIG. 2 is a top plan view of a container portion of the device of FIG. 1.
Figure 3:
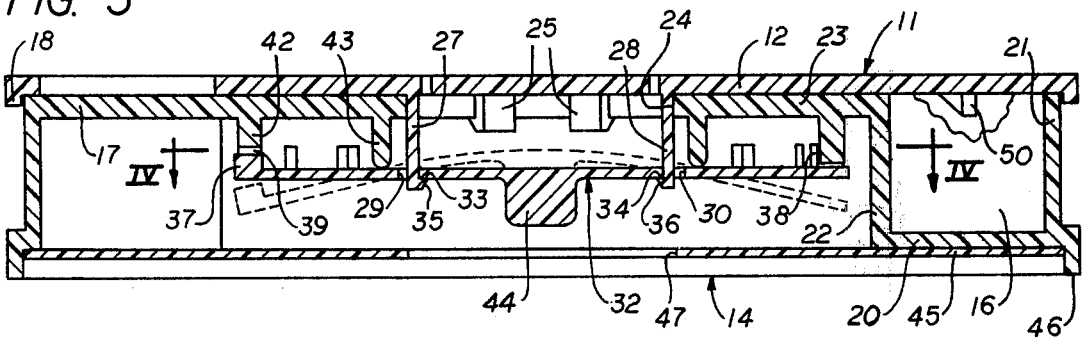
FIG. 3 is a sectional view taken substantially along line III—II of FIG. 1.

Reference numeral 10 generally designates a medication dispenser device constructed in accordance with the principles of the invention. The device 10 comprises dispenser means 11 generally in the form of a circular disc having a planar wall 12 with an opening 13 therein. The dispenser means 11 is mounted for rotation on container means 14, FIG. 2 being a top plan view thereof. The container means 14 defines a plurality of angularly spaced pockets or compartments 15 separated by radially extending wall portions 16, each compartment 15 being arranged to receive one or more tablets or capsules. The pockets or compartments and indexing means therefor may vary in shape and location according to the type of medication to be dispensed and the number to be stored. In the illustrated arrangement, the angle between adjacent wall portions 16 is 24° and there are 14 of the compartments 15 and a wall portion 17 extends between two of the compartments 15 to define a blank area positioned opposite the opening 13 in the initial filled condition of the device. By rotating the dial or dispenser 12 in one direction, for example, counter-clockwise as viewed in FIG. 1, the opening 13 can be sequentially positioned opposite the compartments for removal of tablets or capsules therefrom. For rotation of the dial or dispenser 11, it has a peripheral rim portion 18 which as illustrated in FIG. 3 may project downwardly to surround an upper portion of the container 14. The rim 18 defines engagement means for engagement by one or more fingers of the user to rotate the dial or dispenser 11 relative to the container 14.

The container 14, as shown in FIG. 3, includes an annular bottom wall 20 in parallel relation to the dispenser wall 12 and defining the bottom walls of the compartments 15, an outer annular wall 21 defining the outer walls of the compartments 15 and an inner annular wall 22 defining the inner walls of the compartments 15. Container 14 further includes a central support wall in a plane adjacent that of the wall 12, the outer peripheral portion of the wall being integrally joined to the upper edge of the annular wall 22 and to the inner edge of the blank wall portion 17. Wall 23 has a central circular opening 24 and projection means extend from the wall 12 through the opening 24 for journalling the dispenser 11 for rotation on the container 14. Such projection means include four lugs 25, two of which appear in the sectional view of FIG. 3. Each of such lugs 25 has an upwardly facing radially outwardly projecting shoulder for engaging the lower surface of the wall 23 adjacent the opening 24 therein and for preventing upward movement of the dispenser 11 and each of such lugs preferably also has a bevelled outer face for resilient inward deformation of the lugs 25 to permit installation of the dispenser with a snap action. The projection means further include a pair of diametrically opposite lugs 27 and 28 which extend downwardly through openings 29 and 30 in a lock bar 32. The lugs 27 and 28 have radially inwardly projecting upwardly facing shoulders 33 and 34 for limiting downward movement of the lock bar 32 and have bevelled faces 35 and 36 for camming the lugs 27 and 28 radially outwardly to permit installation of the lock bar 32 with a snap action, the lugs 27 and 28 being resiliently defectable for this purpose.

A pair of lugs 37 and 38 project upwardly from opposite ends of the lock bar 32 to engage in a pair of diametrically opposed slots 39 and 40 in a locking ring 42 projecting downwardly from the wall 23 inside the inner compartment wall l22, the locking bar 42 having a number of such slots corresponding to the compartments 15 and the blank wall portion 17. Upward movement of portions of the lock bar 32 intermediate the central axis and the outer end portions thereof is limited by a ring portion 43 depending from the wall 23 outside the opening 24 therein. When the central portion of the lock bar 32 is moved upwardly, the lock bar is resiliently bent into an arcuate shape and the locking lugs 37 and 38 are moved downwardly out of the slots in the ring 42 as indicated in dotted lines, thereby releasing the dispensing means 11 to permit movement thereof relative to the container 14. The central portion of the lock bar 32 may form engagement means for this purpose or, preferably, it is formed with a downwardly projecting central button portion 44 for this purpose. A disc 45 is preferably inserted within a downwardly projecting flange portion 46 of the container 14 and has a central opening for access to the button 44. Preferably, operating instructions may be carried by the disc 45. For example, the disc may be imprinted with the legend "To dispense tablet or capsule press with index finger through hole and rotate dial to next opening."

It will be appreciated that with this construction of the device 10, it cannot be readily operated by young children or infants, the dispensing means being securely locked against movement relative to the container. Operation requires both movement of the central portion of the lug bar 32 upwardly and simultaneously rotation of the dispenser means 11.

The device is also inexpensively manufacturable and in this connection, it is noted that all parts may be molded from plastic. The instruction disc 45 can either be molded from plastic or may be simply stamped from thin plastic or cardboard. With respect to molding, it is noted that the wall 12 is formed with openings 48 aligned with the shoulders of the lugs 25 and openings 49 aligned with the shoulders 33 and 34 of the lugs 27 and 28.

It is also noted that the wall 12 is preferably formed with a downwardly extending ratchet portion 50 for riding over the upper edges of the wall portions 16 and permitting movement of the dial or dispenser 11 in one direction while preventing movement in the opposite direction.

Figure 5:
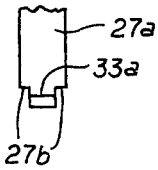
FIG. 5 is a view illustrating a modified lug construction usable in the device of FIGS. 1—4.
Figure 4:
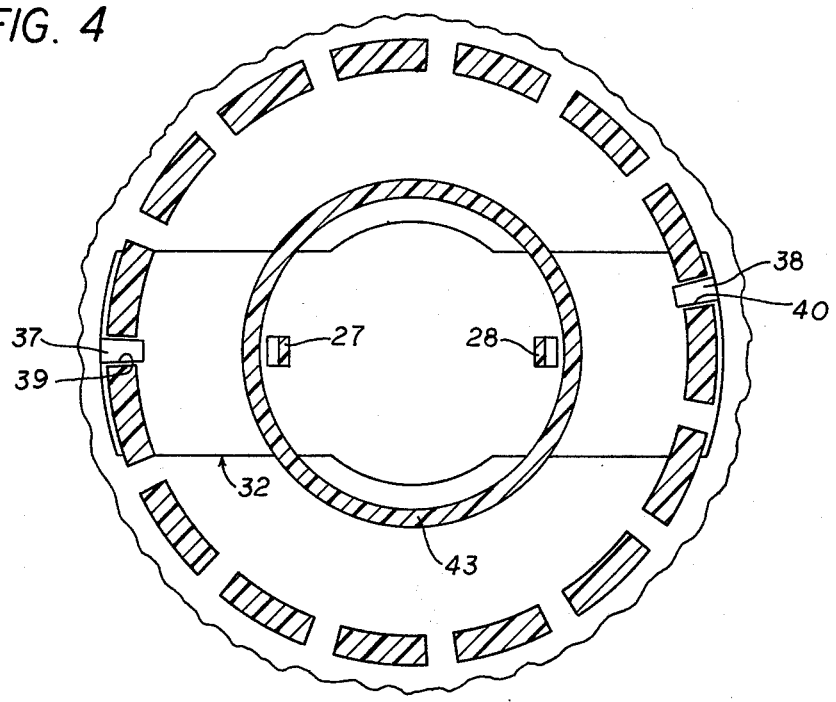
FIG. 4 is a sectional view taken substantially along line IV—IV of FIG. 3.

In FIG. 5, reference numeral **27*a* indicates a modified form of lug useable in place of lug 27 with a similar modified form of lug being used in place of the diametrically opposite lug 28. Lug 27*a* has a pair of downwardly facing shoulders 27*b* to limit upward movement of the portion of lock bar 32 engaged therewith. With this construction, the ring portion 43** can be eliminated.

Figure 6:
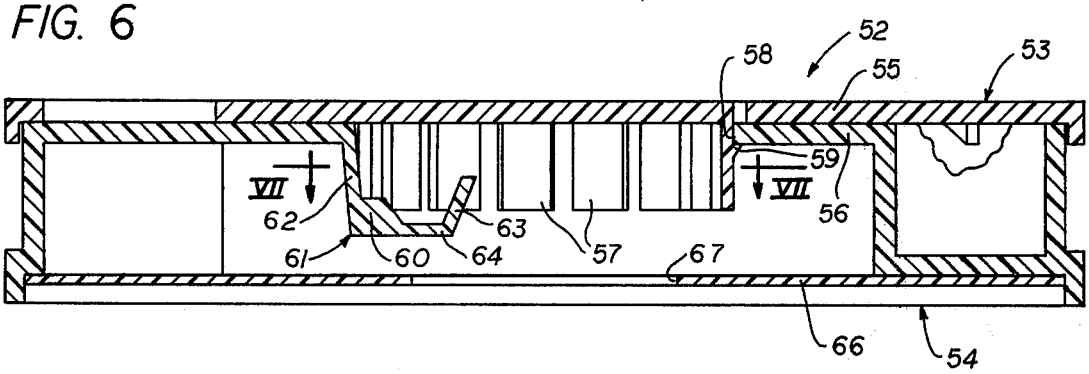
FIG. 6 is a sectional view similar to FIG. 3 but illustrating a modified form of device according to the invention.
Figure 7:
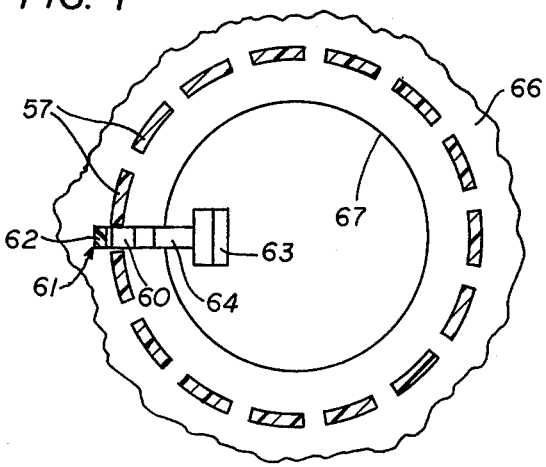
FIG. 7 is a sectional view taken substantially along line VII—VII of FIG. 6.

Referring now to FIGS. 6 and 7, reference numeral 52 generally designates a modified form of device constructed in accordance with the principles of the invention. The device 52 includes a dial or dispenser 53 similar to the dispenser 11 of the device 10 and a container 54 similar to the container 14 of the device 10, the dispenser 53 having a wall 55 corresponding to the wall 12 and the container 54 having a wall 56 corresponding to the wall 23. In the device 52, a plurality of projections 57 project downwardly from the wall 55 through an opening 58 in the wall 56, each of the projections 57 having a lug 59 defining an upwardly facing shoulder for retaining the dispenser 53 on the container 54, the roller faces of the lugs 59 being bevelled for assembly with a snap action. The projections 57 are spaced from one another to define slots into which a portion 60 of a lock member 61 extends to lock the dial or dispenser 53 against rotation. The lock member 61 has a resiliently deformable portion 62 extending upwardly and integrally secured at its upper end to the wall 56. Member 61 is additionally formed with a portion 63 extending angularly inwardly and upwardly, the lower end of portion 63 being secured to the portion 60 through a radially extending portion 64.

In operation, the portion 63 is engaged by a finger of the user and moved radially outwardly to move the portion 60 out of one of the slots between lugs 57, the portion 62 being deformed during such operation. The dial or dispenser 53 may then be rotated by engagement with the outer rim portion thereof.

A disc 66 is provided similar to the disc 45 and having a central opening 67 for access to the portion 63 of lock member 61. The disc 66 may be imprinted with a suitable legend such as, for example, "To dispense table or capsule, press to side with index finger through hole and rotate dial to next opening."

It will be understood that modification and variations may be effected without departing from the spirit and scope of the novel concepts of this invention.

I claim as my invention:

1. In a device for holding a plurality of discrete dosages of medications or the like and for dispensing said dosages one at a time at selected intervals of time, container means having a plurality of compartments for holding said discrete dosages in spaced apart relation, said compartments being disposed in angularly spaced relation at a fixed radial distance from an axis and having open ends in a common plane transverse to said axis, said container means including inner, outer and bottom annular walls defining inner, outer and bottom walls of said components and further including a central support wall having a peripheral portion joined to said inner annular wall and having a central circular opening, dispenser means including a wall extending over and closing said open ends of said compartments and having an opening alignable with the open end of any selected one of said compartments for removal of a dosage therefrom, mounting means securing said dispenser means on said container means for rotation about said axis into a plurality of positions in each of which said opening is aligned with the open end of a selected one of said compartments, said mounting means including projection means projecting from said wall of said dispenser means through said circular opening to journal said dispenser means for rotation about said axis, means defining shoulders on said projection means for engagement with said support wall adjacent said central circular opening therethrough to substantially prevent axial movement of said dispenser means relative to said container means and to keep said wall of said dispenser means closely adjacent said open ends of said compartments at all times, one of said container and projection means having a plurality of slots respectively corresponding to said compartments and located inside said inner annular wall, said slots being at a fixed radial distance from said axis and having an angular spacing therebetween equal to that between said compartments, and a resiliently deformable lock member having a first portion supported on the other of said container and projection means and having a second portion normally engaged in one of said slots aligned therewith to securely lock said dispenser means against rotation in either direction relative to said container means, said lock member having a third portion engageable by a finger of the user and being resiliently deformable by finger pressure against said third portion to move said second portion out of said one of said slots to permit rotation of said dispenser means.

2. In a device as defined in claim 1, said container means being formed with said slots radially outside said projection means, said projection means being of hollow cylindrical form, said lock member being in the form of a bar having said first portion and a fourth portion supported on diametrically opposed portions of said projection means and having said second portion at one end and a fifth portion at an opposite end engagable with generally diametrically opposed ones of said slots, means engaging said bar adjacent said first and fourth portions to prevent movement thereof toward said dispenser means wall, said second and fifth portions being movable out of said slots by application of finger pressure against a central portion of said bar forming said third portion and located on the inside of said projection means.

3. In a device as defined in claim 2, said third portion being in the form of a protuberance projecting in a direction away from said wall of said dispenser means.

4. In a device as defined in claim 1, said projection means of said mounting means being formed of hollow cylindrical form and being formed with slots, said first portion lock member being secured to said central support wall of said container means, and said third portion being located generally inside said projection means.

5. In a device as defined in claim 4, said second portion of said lock member being movable radially outwardly to move out of said slots in response to radially outward pressure against said third portion.

* * * * *